US010252884B2

(12) United States Patent
Hu

(10) Patent No.: US 10,252,884 B2
(45) Date of Patent: Apr. 9, 2019

(54) WIRELESSLY POWERED ELEVATOR ELECTRONIC SAFETY DEVICE

(71) Applicant: Otis Elevator Company, Farmington, CT (US)

(72) Inventor: Guohong Hu, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 404 days.

(21) Appl. No.: 15/091,246

(22) Filed: Apr. 5, 2016

(65) Prior Publication Data

US 2017/0283215 A1 Oct. 5, 2017

(51) Int. Cl.

*B66B 1/06* (2006.01)
*B66B 7/00* (2006.01)
*B66B 5/22* (2006.01)

(52) U.S. Cl.

CPC . *B66B 7/00* (2013.01); *B66B 5/22* (2013.01)

(58) Field of Classification Search

CPC ..... B66B 7/00; B66B 5/22
USPC ..... 187/247, 277, 288, 289, 290, 293, 391, 187/393

See application file for complete search history.

(56) References Cited

U.S. PATENT DOCUMENTS 4,011,928 A 3/1977 Spear et al.
5,495,919 A 3/1996 Ericson et al.
5,732,795 A * 3/1998 McCarthy ..... B66B 1/34 187/250
5,782,319 A 7/1998 Woodruff et al.
6,196,355 B1 * 3/2001 Fargo ..... B66B 3/00 187/287
6,408,986 B1 * 6/2002 Ayano ..... B66B 1/461 187/290
6,412,604 B1 * 7/2002 Schuster ..... B66B 1/30 187/290
6,457,569 B2 10/2002 Draper et al.
6,626,267 B2 * 9/2003 Beus ..... B66B 1/34 187/290
6,629,583 B2 * 10/2003 Valk ..... B66B 1/34 187/290
7,097,001 B2 * 8/2006 Martin ..... B66B 13/24 187/290
7,104,363 B2 * 9/2006 Mori ..... B66B 1/30 187/290
7,134,529 B2 11/2006 Maury
(Continued)

FOREIGN PATENT DOCUMENTS

WO 2010112675 A2 10/2010
WO 2015191696 A1 12/2015

OTHER PUBLICATIONS

Nationwide Lifts, Elevator Safety Features.
European Search Report for application EP 17165080.7, dated Feb. 12, 2018, 8 pages.

*Primary Examiner* — Anthony Salata
(74) *Attorney, Agent, or Firm* — Cantor Colburn LLP

(57) ABSTRACT

An elevator system including a hoistway, an elevator component disposed in the hoistway, and a power assembly disposed in the hoistway, the power assembly including a first power component disposed in the hoistway, the first power component including a first power connection, and a second power component operably coupled to the elevator component; wherein the first power component is configured to provide wireless power to the second power component.

12 Claims, 4 Drawing Sheets

(56) References Cited

U.S. PATENT DOCUMENTS

| | | | | |
|---|---|---|---|---|
| 7,228,943 | B2 * | 6/2007 | Kugiya | B66B 5/06 187/287 |
| 7,475,756 | B2 | 1/2009 | Maury et al. | |
| 7,681,693 | B2 * | 3/2010 | Tegtmeier | B66B 1/30 187/288 |
| 7,896,137 | B2 * | 3/2011 | Ishikawa | B66B 11/005 187/290 |
| 8,297,411 | B2 * | 10/2012 | Hashimoto | B66B 1/285 187/288 |
| 9,027,714 | B2 | 5/2015 | Hussman et al. | |
| 9,169,104 | B2 | 10/2015 | Legeret et al. | |
| 9,837,860 | B2 * | 12/2017 | McCarthy | H02J 7/025 |
| 2011/0266097 | A1 | 11/2011 | Valjus et al. | |
| 2013/0248296 | A1 | 9/2013 | Husmann | |
| 2014/0326544 | A1 | 11/2014 | Husmann | |
| 2014/0332324 | A1 | 11/2014 | Husmann | |
| 2015/0251876 | A1 | 9/2015 | Fauconnet et al. | |
| 2015/0274487 | A1 | 10/2015 | Annen et al. | |
| 2017/0057780 | A1 * | 3/2017 | Nguyen | H04W 4/70 |
| 2017/0291798 | A1 * | 10/2017 | Hu | B66B 1/32 |

* cited by examiner

WIRELESSLY POWERED ELEVATOR ELECTRONIC SAFETY DEVICE

TECHNICAL FIELD OF THE DISCLOSED EMBODIMENTS

The present disclosure is generally related to braking and/or safety systems for elevator systems and, more specifically, an electronic safety device with a power assembly.

BACKGROUND OF THE DISCLOSED EMBODIMENTS

Some machines, such as an elevator system, include a safety system to stop the machine when it rotates at excessive speeds or the elevator cab travels at excessive speeds or accelerations. Conventional safety systems include an actively applied safety system that hrequires power from travelling cables to positively actuate the safety mechanism or a passively applied safety system that requires power from travelling cables to maintain the safety system in a hold operating state. There is therefore a need for a more robust safety system with reduced complexity and power requirements for reliable operation without the need of additional travelling cables or additional power wires to the elevator car and/or counterweight.

SUMMARY OF THE DISCLOSED EMBODIMENTS

In one aspect, an elevator system is provided. The elevator system includes a hoistway, an elevator component disposed in the hoistway, and a power assembly disposed in the hoistway. The power assembly includes a first power component disposed in the hoistway, the first power component including a first power connection, and a second power component operably coupled to the elevator component; wherein the first power component is configured to provide wireless power to the second power component.

In an embodiment, the elevator component comprises at least one of an elevator car and a counterweight. In an embodiment, the elevator system further includes an elevator drive operably coupled to the elevator car.

In an embodiment, the second power component is configured to connect to the first power component via a direct connection or an indirect connection. In an embodiment, the first power component is operably coupled to a power source.

In an embodiment, the second power component includes a second power connection, a power storage device operably coupled to the second power connector, and a safety actuation controller including a communication module, the safety actuation controller operably coupled to the power storage device. In an embodiment, the communication module is configured to wirelessly exchange safety signals with the elevator controller.

In an embodiment, the elevator system further includes a guide rail disposed in the hoistway; the guide rail configured to engage the elevator component and direct the course of travel of the elevator component. In an embodiment, the first power component is operably coupled to the guide rail.

In an embodiment, the elevator system further includes a safety actuation device operably coupled to the elevator component, the safety actuation device configured to engage the guide rail. In an embodiment, the second power component is operably coupled to the safety actuation device.

In one aspect, an elevator safety actuation device is provided. The elevator safety actuation device includes a power component and an electromagnetic component operably connected to the power component, wherein the electromagnetic component is configured generate an actuation or a reset. The power component includes a safety actuation controller, a power storage device operably coupled to the safety actuation controller, and a first connector operably coupled to the first power storage device.

In an embodiment, the electronic safety device further includes a magnetic brake disposed adjacent to the electromagnetic component, the magnetic brake configured to move between an engaging position and a non-engaging position based in part on a holding force.

In an embodiment, the safety controller comprises a communication module. In an embodiment, the communication module is configured to wirelessly receive and transmit safety signals.

In an embodiment, the elevator safety device further includes a second connector configured to engage the first connector. In an embodiment, the second connector is removable.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
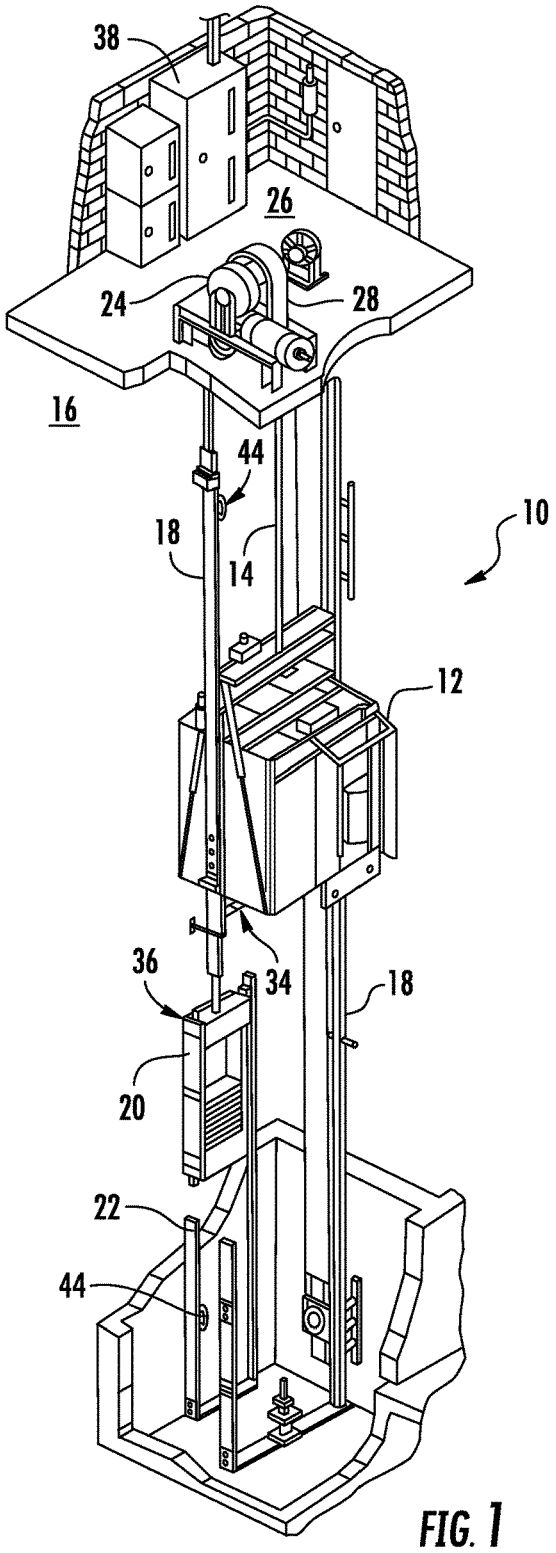
FIG. 1 is a schematic diagram of an elevator system employing an electronic safety actuation device to the elevator car and/or counterweight.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 shows an embodiment of an elevator system, generally indicated at 10. The elevator system 10 includes an elevator component disposed in a hoistway 16. In an embodiment, the elevator component includes at least one of an elevator car 12 and a counterweight 20. The elevator car 12 suspended by a cable 14 in the hoistway 16. The elevator car 12 is guided between car guide rails 18. The counterweight 20 is guided between counterweight guide rails 22 and is suspended on an opposite end of the cable 14.

Movement of the elevator car 12 and counterweight 20 in the hoistway 16 is provided by a motor 24 mounted in a machine room 26. The motor 24 rotates a sheave 28 around which the cable 14 extends to raise and lower the elevator car 12.

An electromechanical brake (not shown) located in the machine room 26, electronic safety actuation devices, car safeties 34, and/or counterweight safeties 36 act to stop elevator car 12 and counterweight 20 if the elevator car 12 or counterweight 20 exceed a set speed as it travels inside the hoistway 16. If the elevator car 12 or counterweight 20 reaches a defined over-speed condition; thus, transmitting a signal to an elevator drive 38, which in turn cuts power to the elevator drive 38 and drops the brake to arrest movement of the sheave 28 and thereby arrest movement of elevator car 12.

If, however, cables 14 break or the elevator car 12 otherwise experiences a free-fall condition unaffected by the brake, the electronic safety actuation device may then act to actuate either or both of the car safety 34 and counterweight safety 36 to arrest movement of the elevator car 12 and/or counterweight 20.

Figure 2:
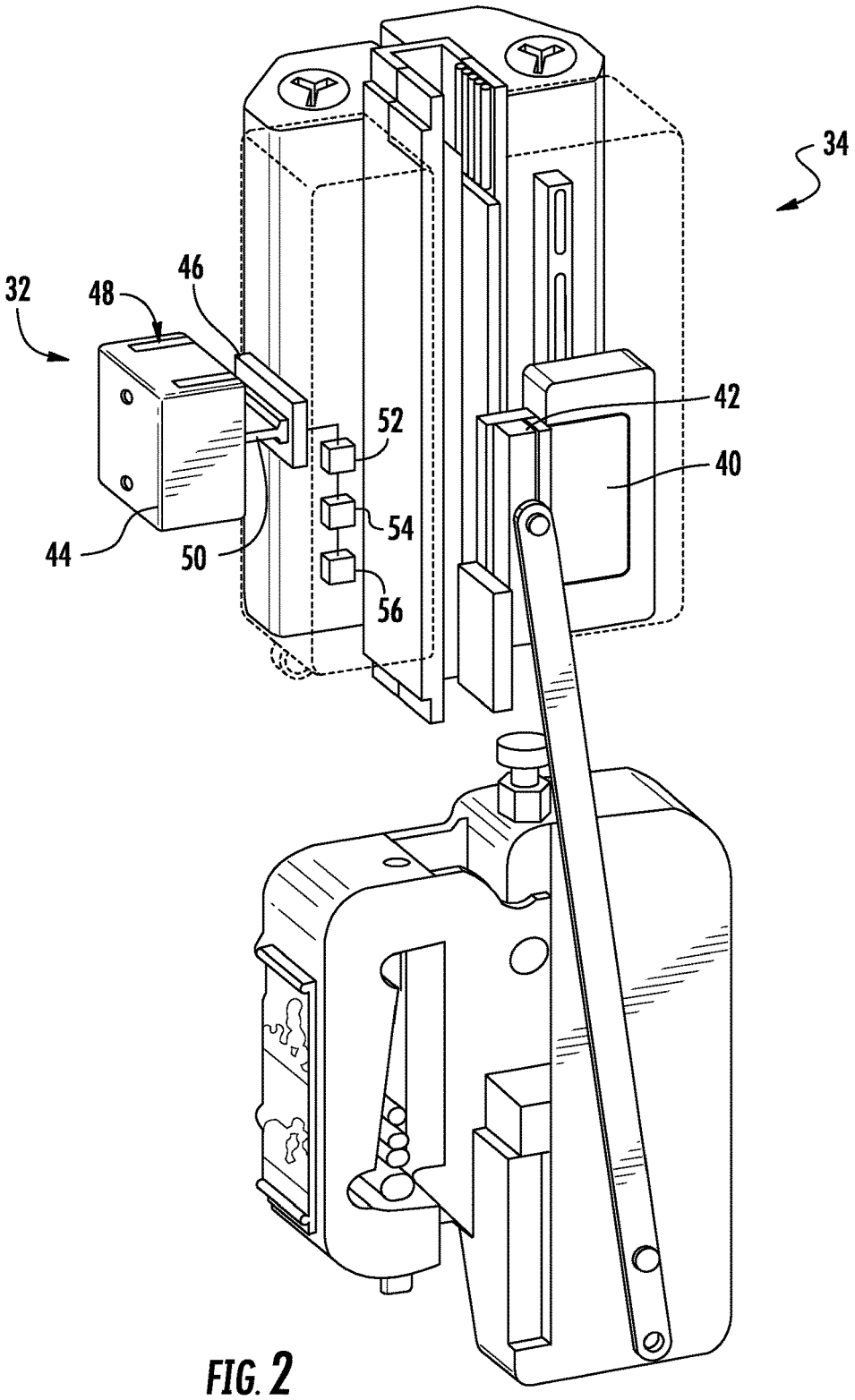
FIG. 2 is a schematic cross-sectional view of an exemplary electronic safety actuation device, in a non-engaging position according to an embodiment of the present disclosure.

FIG. 2 shows an embodiment of a power assembly 32 in use with an exemplary electronic safety actuation device that may be employed on the elevator car 12 (i.e., car safety 34) and/or counterweight 20 (i.e., counterweight safety 36). In an embodiment, the electronic safety actuation device includes an electromagnetic component 40 and a magnetic brake 42. It will be appreciated that the exemplary safety device may include similar components as described below.

In order to power the electromagnetic component 40, the power assembly 32 is disposed within the hoistway 16. The power assembly 32 includes a first power component 44 configured to provide power to a second power component 46, wherein the second power component 46 is disposed on at least one of the elevator car 12 and the counterweight 20.

In an embodiment, the first power component 44 is configured to provide power to the second power component 46 via a direct connection or an indirect connection. For example, the first power component 44 may connect to the second power component 46 via a plug and socket connector, inductive charging, conductive charging, wireless power, and/or an outlet to name a few non-limiting examples.

The first power component 44 includes a first component connector 48, and the second power component 46 includes a second component connector 50, such that when the first component connector 48 and the second component connector 50 are connected, power is transferred from the first power component 44 to the second power component 46.

The second power component 46 further includes a first power storage device 52 operably coupled to the second component connector 50. The first power storage device 52, for example a battery to name one non-limiting example, is further coupled to an electronic safety actuation device controller 54. The electronic safety actuation device controller 54 is further coupled to a second power storage device 56. The second power storage device 56, for example a capacitor to name one non-limiting example, is further coupled to a portion of the electronic safety actuation device (e.g., the electromagnetic component 40), and is configured to activate the safety actuation device based in part on an actuation command.

The electronic safety actuation device controller 54 is in communication with the elevator drive 38 via a communication module (not shown) disposed on the electronic safety actuation device controller 54. In an embodiment, the communication module is configured to wirelessly exchange safety signals with the elevator drive 38. It will be appreciated that the communication module may be separate from the electronic safety actuation controller 54.

In an embodiment, the first power component 44 may be disposed within the hoistway 16 and operably coupled to the power source without the need of a traveling cable. In the embodiment shown in FIG. 1, first power component 44 is disposed at the top of the hoistway 16 on a support adjacent to the car guide rails 18. Another first power component 44 may be disposed at the bottom of the hoistway 16 on a support adjacent to the counterweight guide rails 22. In this embodiment, when the elevator car 12 is parked at the top of the hoistway 16, the counterweight 20 is at the bottom of the hoistway.

In an embodiment, the first power component 44 may be placed at locations along the hoistway 16 corresponding to positions of the counterweight 20 when the elevator car 12 is stopped at each of the floors in the building, or at some subset of floors.

Figure 3:
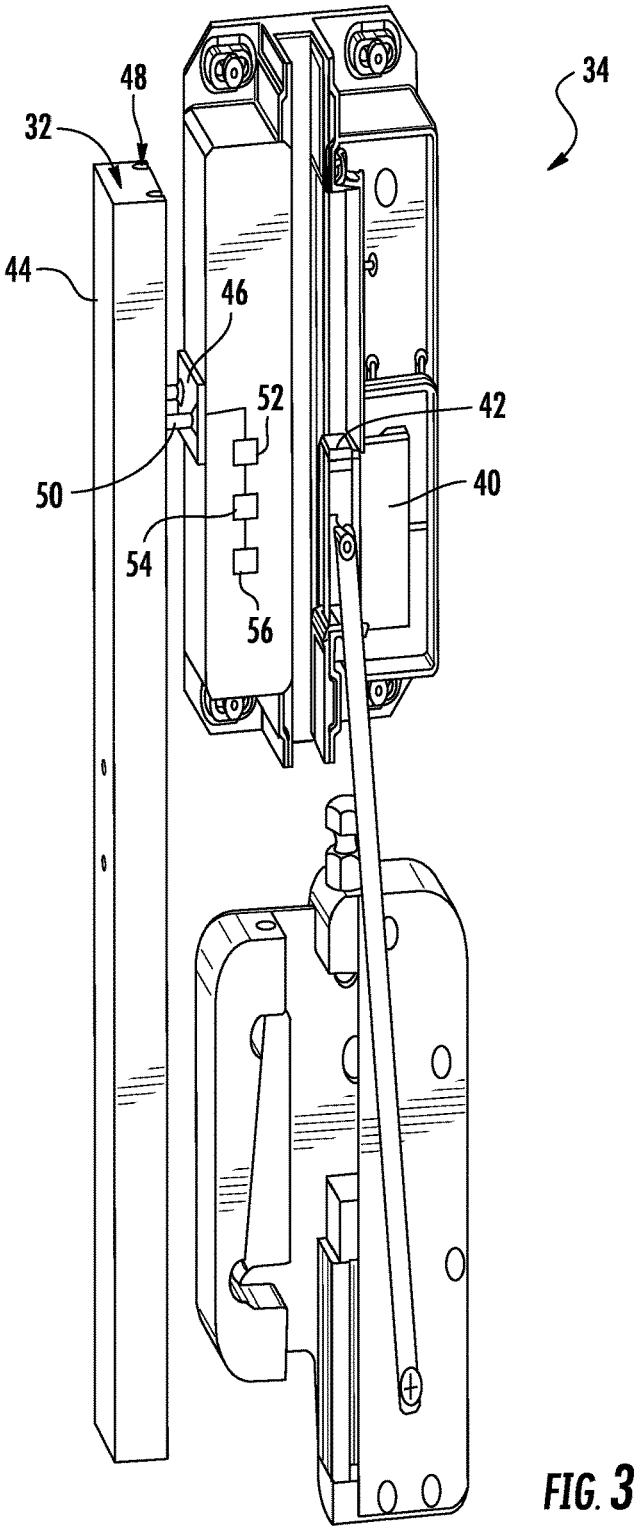
FIG. 3 is a schematic cross-sectional view of an exemplary electronic safety actuation device, in a non-engaging position according to another embodiment of the present disclosure.

In another embodiment, as shown in FIG. 3, the first power component 44 may be a power rail to name one non-limiting example. Thus, it will be appreciated that the first power component 44 may be disposed in any location, or at multiple locations within the hoistway 16. The second power component 46 is operably coupled to a portion of the elevator car 12 and/or counterweight 20 (e.g., the electronic safety actuation device, the car safety 34 and/or the counterweight safety 36).

During typical operation, the electromagnetic component 40 is a keeper configured to hold the magnetic brake 42 in a non-engaging position without power needed. The magnetic brake 42 provides a sufficient magnetic attraction force in a direction toward the electromagnetic component 40 to hold the magnetic brake 42 in the non-engaging position.

During an overspeed or other condition requiring braking, the elevator drive 38 may wirelessly transmit a safety signal to the electronic safety actuation device controller 54 to actuate the electromagnetic component 40. In one embodiment, the electronic safety actuation device controller 54 may itself sense the overspeed or other condition requiring braking and actuate the electromagnetic component 40. Upon receipt of the safety signal, the electronic safety actuation device controller 54 may issue an actuation command to the electromagnetic component 40 to propel the magnetic brake 42 towards a guide rail into an engaging position by using the power from the second power storage device 56.

Figure 4:
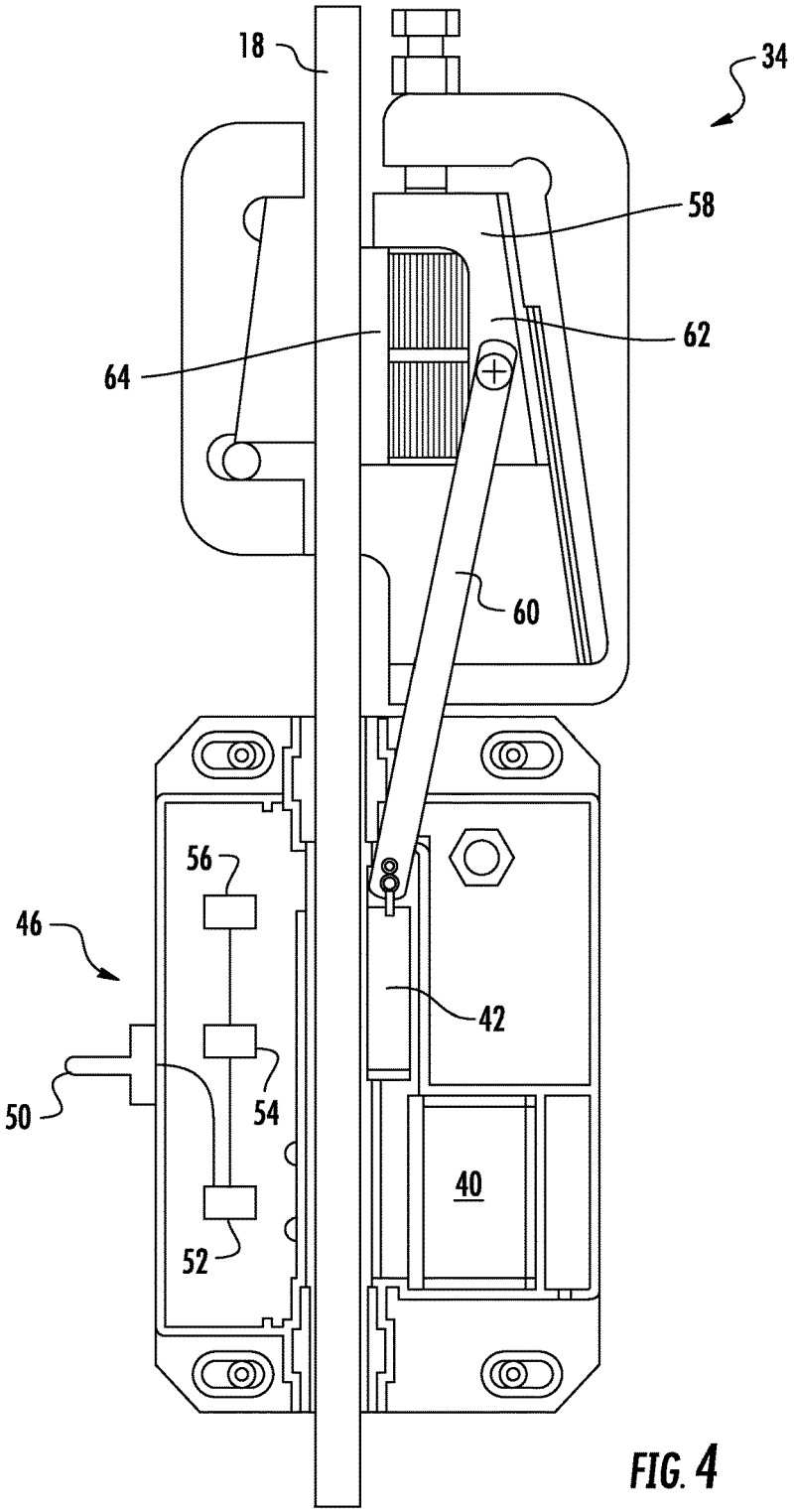
FIG. 4 is a schematic cross-sectional view of an exemplary electronic safety actuation device, in an engaging position according to an embodiment of the present disclosure.

In the rail-engaging position, illustrated in FIG. 4, the exemplary magnetic brake 42 is magnetically attached to the car guide rail 18 (or counterweight guide rails 22). The magnetic brake 42 is operably coupled to a safety brake 58 by a rod or small linkage bar 60. The magnetic brake 42, in the rail-engaging position, pushes/pulls the safety brake 58 in an upward direction due to the relative upward movement of the magnetic brake 42 relative to the descending elevator car 12. The safety brake 58 engages the car guide rail 18 (or counterweight guide rails 22) when the magnetic brake 42 pushes/pulls the safety brake 58 in the upward direction. A wedge-shaped portion 62 of the safety brake 58 allows a safety brake pad 64 to move toward and engage with the car guide rail 18 (or counterweight guide rails 22) upon upward movement of the magnetic brake 42 and the rod 60.

The first power storage device 52 is able to maintain or restore the stored power when the first component connector 48 is connected to the second component connector 50. This is accomplished when the first power component 44 is positioned to be adjacent to the second power component 46 such that the first component connector 48 may engage or mate with the second component connector 50. For example, when the elevator car 12 is stationary at a landing (e.g., top) or running in the hoistway 16, the first power component 44 is positioned to be adjacent to the second power component 46 such that the first component connector 48 may engage or mate with the second component connector 50. Power may then be transferred from the first power component 44 to the first power storage device 52 via the second power connector 50. This arrangement, therefore, eliminates the need for a travelling cable to power the electronic safety actuation device (connected to the car safety 34 and/or connected to the counterweight safety 36).

It will therefore be appreciated that the present elevator system 10 includes a power assembly 32 employed on an electronic safety actuation device (connected to car safeties 34, and/or counterweight safeties 36) to actuate the safety without the need of additional traveling cables for power; thus, decreasing the costs of material and installation time of the elevator system 10.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. An elevator system comprising:

a hoistway;

an elevator component disposed in the hoistway; and a power assembly disposed in the hoistway, the power assembly comprising:

a first power component disposed in the hoistway, the first power component comprising a first power connection; and a second power component operably coupled to the elevator component;

wherein the first power component is configured to provide wireless power to the second power component;

a guide rail disposed in the hoistway, the guide rail configured to engage the elevator component and direct the course of travel of the elevator component; and a safety device operably coupled to the elevator component, the safety device configured to engage the guide rail to stop the elevator component;

wherein the second power component is operably coupled to the safety device.

2. The elevator system of claim 1, wherein the second power component is configured to connect to the first power component via a direct connection or an indirect connection.

3. The elevator system of claim 1, wherein the first power component is operably coupled to a power source.

4. The elevator system of claim 1, wherein the second power component comprises:

a second power connection;

a first power storage device operably coupled to a second power connector;

a safety actuation controller comprising a communication module, the safety actuation controller operably coupled to the first power storage device.

5. The elevator system of claim 1, wherein the first power component is operably coupled to the guide rail.

6. The elevator system of claim 1, wherein the elevator component comprises at least one of an elevator car and a counterweight.

7. The elevator system of claim 6, further comprising an elevator drive configured to impart movement to the elevator car.

8. The elevator system of claim 4, wherein the communication module is configured to wirelessly exchange safety signals with the elevator controller.

9. The elevator system of claim 4 wherein the second power component further comprises:

an electromagnetic component operably connected to the second power component, wherein the electromagnetic component is configured generate an actuation of the safety device.

10. The elevator system of claim 9, further comprising:

a magnetic brake disposed adjacent to the electromagnetic component, the magnetic brake configured to move between an engaging position and a non-engaging position based in part on a hold force.

11. The elevator system of claim 9, wherein the safety actuation controller comprises a communication module, wherein the communication module is configured to wirelessly communicate safety signals.

12. The elevator system of claim 9, wherein the first power component includes a first power connector and the second power component includes a second power connector configured to engage the first power connector.

* * * * *